US012490846B1

(12) United States Patent
Cheng

(10) Patent No.: US 12,490,846 B1
(45) Date of Patent: Dec. 9, 2025

(54) WEIGHTED BLANKET

(71) Applicant: Min Cheng, Zhejiang (CN)

(72) Inventor: Min Cheng, Zhejiang (CN)

( * ) Notice: Subject to any disclaimer, the term of this patent is extended or adjusted under 35 U.S.C. 154(b) by 0 days.

(21) Appl. No.: 19/098,619

(22) Filed: Apr. 2, 2025

(51) Int. Cl.

| | |
|---|---|
| ***A47G 9/02*** | (2006.01) |
| ***D04B 1/10*** | (2006.01) |
| ***D04B 1/12*** | (2006.01) |
| ***D04B 1/22*** | (2006.01) |

(52) U.S. Cl.
CPC ..... *A47G 9/0223* (2013.01); *D04B 1/104* (2013.01); *D04B 1/12* (2013.01); *D04B 1/22* (2013.01); *D10B 2503/00* (2013.01)

(58) Field of Classification Search
CPC ..... A47G 9/02; A47G 9/0223; A47G 9/284; D04B 1/0104; D03D 1/0017
See application file for complete search history.

(56) References Cited

U.S. PATENT DOCUMENTS

| | | | | |
|---|---|---|---|---|
| 9,788,661 | B1 * | 10/2017 | Alletto | A47C 21/042 |
| 2002/0157429 | A1 * | 10/2002 | Matsumoto | D04B 21/10 66/195 |
| 2003/0106346 | A1 * | 6/2003 | Matsumoto | D04B 21/10 66/195 |
| 2012/0260422 | A1 * | 10/2012 | Rock | B32B 5/024 5/486 |
| 2014/0115783 | A1 * | 5/2014 | Rock | D04B 1/04 5/482 |
| 2016/0281279 | A1 * | 9/2016 | Liran | D04B 1/18 |

FOREIGN PATENT DOCUMENTS

| | | | | |
|---|---|---|---|---|
| CN | 104379028 A | * | 2/2015 | B32B 5/26 |
| CN | 109137241 A | * | 1/2019 | A47G 9/02 |
| CN | 217536313 U | * | 10/2022 | |
| JP | 2005232602 A | * | 9/2005 | |
| KR | 20110022943 A | * | 3/2011 | G06Q 50/04 |
| WO | WO-2010037082 A2 | * | 4/2010 | A47G 9/02 |

OTHER PUBLICATIONS

Chattopadhyay, R. Kumar Sinha, Sujit Regar, Madan Lal. (2023). Textile Calculation—Fibre to Finished Garment—1.9 Garmenting Process Flow Chart. (pp. 11). Elsevier. Retrieved from <br>https://app.knovel.com/hotlink/pdf/id:kt0141H711/textile-calculation-fibre/garmenting-process-flow (Year: 2023).*

* cited by examiner

*Primary Examiner* — Eric J Kurilla
(74) *Attorney, Agent, or Firm* — HOWARD M COHN and Associates, LLC

(57) ABSTRACT

A weighted blanket is provided, including a blanket body. The blanket body is knitted from a thick yarn, the thick yarn includes a flexible mesh body, the flexible mesh body extends along an axial direction of the thick yarn, and the flexible mesh body forms ventilation mesh holes. The thick yarn inherently provides sufficient weight, eliminating a need for additional weighting materials, thereby preventing uneven pressure distribution. The flexible mesh body of the thick yarn combines softness with enhanced breathability, effectively addressing issues of poor breathability, uneven pressure distribution, and limited flexibility of current weighted blankets.

14 Claims, 5 Drawing Sheets

WEIGHTED BLANKET

TECHNICAL FIELD

The present disclosure relates to the field of weighted blankets, and in particular to a weighted blanket.

BACKGROUND

A deep pressure therapy technique involves placing a blanket of a certain weight on a human body to apply pressure, creating a sense of security akin to being hugged or swaddled. Conventional fabrics lack sufficient pressure intensity to effectively deliver deep pressure therapy when placed on the human body, often requiring additional weighted materials. As such, conventional deep pressure therapy blankets are multilayered weighted blankets with additional weighting materials embedded between fabric layers. The additional weighting materials typically include plastic pellets or balls, glass beads, sand, gravel, linked chain-shaped objects, etc. The additional weighting materials are generally placed in units within the blanket. For example, the additional weighting materials are typically configured as secondary patches that are sewn or stitched for encapsulating weights.

However, use of the additional weighting materials introduces several drawbacks. First, the additional weighting materials restrict breathability. The additional weighting materials and multiple fabric layers of the multilayered weighted blankets impede natural airflow, thereby complicating body temperature regulation for users during use. Second, the additional weighting materials tend to move and/or shift within corresponding multilayered weighted blankets, undermining uniform, continuous weight distribution required for effective deep pressure therapy. In addition, the additional weighting materials result in excessive thickness and reduced flexibility, preventing the corresponding multilayered weighted blankets from conforming to body contours of the users beneath them and thereby reducing a therapeutic surface contact area.

Due to poor breathability, uneven pressure distribution, and limited flexibility of the multilayered weighted blankets, further research is needed.

SUMMARY

The present disclosure aims to provide a weighted blanket that addresses issues of poor breathability, uneven pressure distribution, and limited flexibility of current weighted blankets.

In order to achieve above aims, the present disclosure adopts technical solutions as follows.

The present disclosure provides the weighted blanket, including a blanket body. The blanket body is knitted from a thick yarn, the thick yarn includes a flexible mesh body, the flexible mesh body extends along an axial direction of the thick yarn, and the flexible mesh body forms ventilation mesh holes.

Furthermore, the thick yarn further includes an air channel, the flexible mesh body is annularly disposed to surround the air channel, and the air channel is communicated with an external environment through the ventilation mesh holes.

Furthermore, the thick yarn is knitted from a fine yarn.

Furthermore, the fine yarn is layered and wound to form a layered structure of the flexible mesh body.

Furthermore, during a layering and winding process of the fine yarn, connecting knots are formed between adjacent wound segments of the fine yarn, and the connecting knots are configured to connect the adjacent wound segments of the fine yarn.

Furthermore, the fine yarn includes sleeving portions extending upward from a current wound segment of the fine yarn and hooking protrusions extending upward from a next wound segment of the fine yarn, each of the sleeving portions is sleeved on a corresponding one of the hooking protrusions to form a corresponding one of the connecting knots.

Furthermore, the fine yarn is knitted on a circular knitting machine to form the flexible mesh body.

Furthermore, the fine yarn is knitted by 6 to twelve latch needles to form the flexible mesh body.

Furthermore, the flexible mesh body is formed by knitting a single strand of the fine yarn.

Furthermore, the single strand of the fine yarn is fed into the circular knitting machine after passing through six latch needles to obtain the thick yarn, the thick yarn has a weight of six grams per meter.

Furthermore, the single strand of the fine yarn is fed into the circular knitting machine after passing through twelve latch needles to obtain the thick yarn, the thick yarn has a weight approximate to thirteen grams per meter.

Furthermore, the flexible mesh body is formed by knitting two strands of the fine yarn.

Furthermore, the two strands of the fine yarn are fed into the circular knitting machine after passing through six latch needles to obtain the thick yarn, the thick yarn has a weight of thirteen grams per meter.

Furthermore, the two strands of the fine yarn are fed into the circular knitting machine after passing through twelve latch needles to obtain the thick yarn, the thick yarn has a weight approximate to twenty-five grams per meter.

Furthermore, the thick yarn is knitted on a flat knitting machine to form the blanket body.

Furthermore, the blanket body has a plurality of knitting patterns.

Furthermore, the blanket body includes a main body portion and a surrounding portion, and the surrounding portion is knitted around the main body portion.

Furthermore, both the main body portion and the surrounding portion have a plurality of knitting patterns.

Beneficial effects of the present disclosure are as following.

According to the present disclosure, the blanket body is knitted from the thick yarn, the thick yarn includes the flexible mesh body, the flexible mesh body extends along the axial direction of the thick yarn, and the flexible mesh body forms the ventilation mesh holes. The thick yarn inherently provides sufficient weight, eliminating a need for additional weighting materials, thereby preventing uneven pressure distribution. The flexible mesh body of the thick yarn combines softness with enhanced breathability, effectively addressing the issues of the poor breathability, the uneven pressure distribution, and the limited flexibility of the current weighted blankets.

BRIEF DESCRIPTION OF DRAWINGS

Drawings constituting a part of the present disclosure are used to provide a further understanding of the present disclosure, and illustrative embodiments of the present disclosure and description thereof are used to explain the present disclosure, and do not constitute an improper limitation to the present disclosure.

In order to more clearly illustrate the technical solutions in embodiments of the present disclosure, accompanying drawings required in description of the embodiments are briefly described below, and obviously, the accompanying drawings in following description are merely some embodiments of the present disclosure, and for those who skilled in the art, other drawings may be obtained according to the accompanying drawings without creative efforts.

REFERENCE NUMERALS IN THE DRAWINGS

1. blanket body;
2. thick yarn;
21. flexible mesh body;
211. ventilation mesh hole;
212. sleeving portion;
213. hooking protrusion;
214. connecting knot;
22. air channel;
3. fine yarn;
4. latch needle;
41. knitting portion;
5. yarn inlet;
6. needle cylinder;
61. needle groove;
7. outer housing;
8. main body portion;
9. surrounding portion.

DETAILED DESCRIPTION OF EMBODIMENTS

In order to make above objects, features, and advantages of the present disclosure more comprehensible, specific embodiments of the present disclosure are described in detail below with reference to the accompanying drawings. In following description, numerous specific details are set forth in order to provide a thorough understanding of the present disclosure. However, the present disclosure is capable of being implemented in many other manners different from those described herein, and those who skilled in the art may make similar improvements without departing from connotation of the present disclosure, and therefore, the present disclosure is not limited by the specific embodiments disclosed below.

Figure 1:
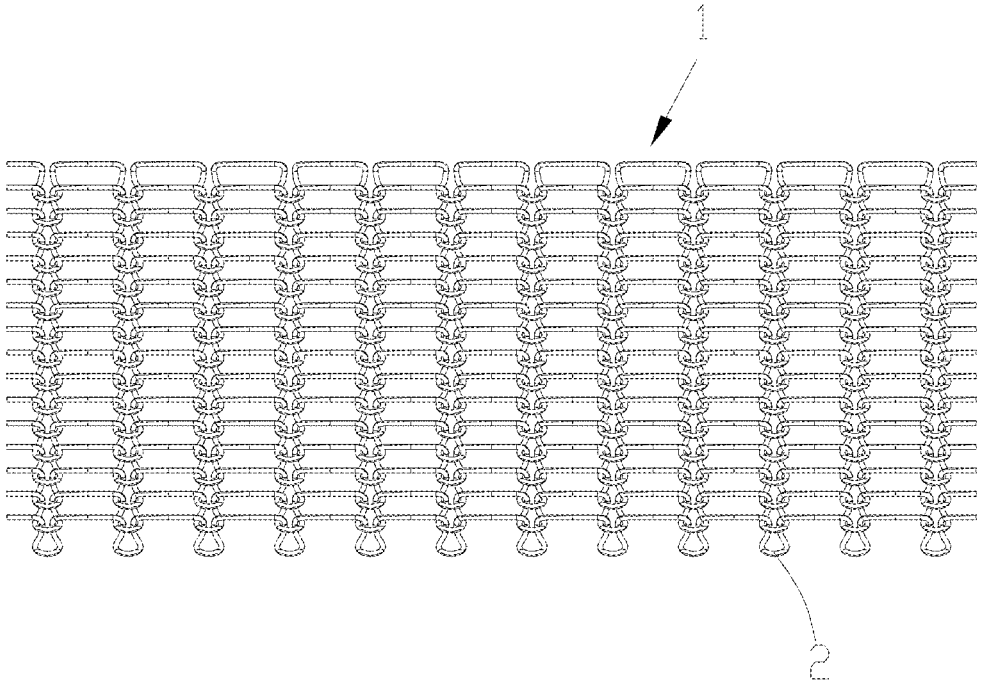
FIG. 1 is a partial structural schematic diagram of a blanket body of a weighted blanket according to the present disclosure.
Figure 2:
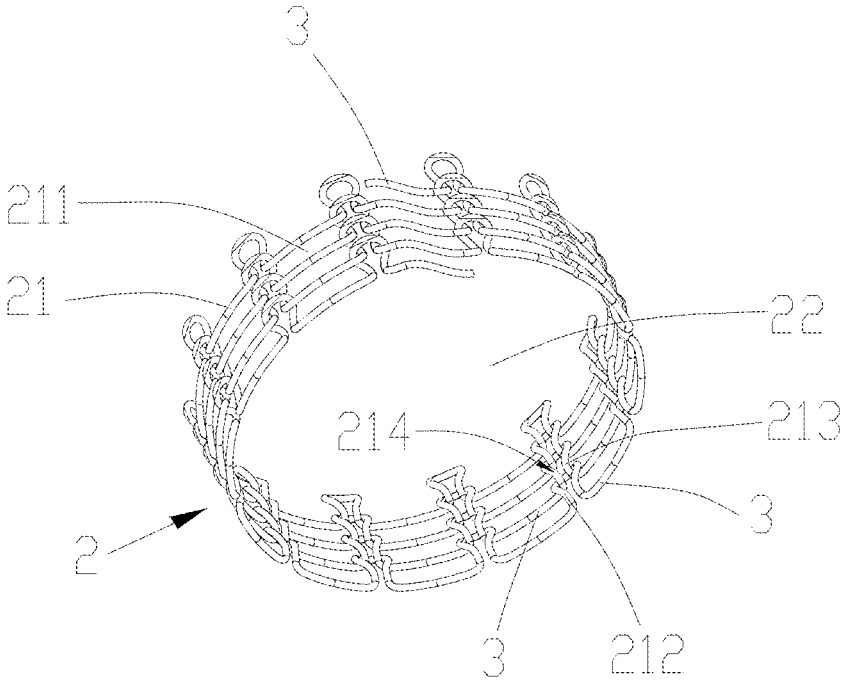
FIG. 2 is a partial structural schematic diagram of a thick yarn according to the present disclosure.

In the embodiments, please refer to FIGS. 1-2, a weighted blanket is provided, including a blanket body 1. The blanket body 1 is knitted from a thick yarn 2, the thick yarn 2 includes a flexible mesh body 21, the flexible mesh body 21 extends along an axial direction of the thick yarn 2, and the flexible mesh body 21 forms ventilation mesh holes 211.

The blanket body 1 is knitted from the thick yarn 2, the thick yarn 2 includes the flexible mesh body 21, the flexible mesh body 21 extends along the axial direction of the thick yarn 2, and the flexible mesh body 21 forms the ventilation mesh holes 211. The thick yarn 2 inherently provides sufficient weight, eliminating a need for additional weighting materials, thereby preventing uneven pressure distribution. The flexible mesh body 21 of the thick yarn 2 combines softness with enhanced breathability, effectively addressing issues of poor breathability, uneven pressure distribution, and limited flexibility of current weighted blankets.

Furthermore, please refer to FIG. 2, the thick yarn 2 further includes an air channel 22, the flexible mesh body 21 is annularly disposed to surround the air channel 22, and the air channel 22 is communicated with an external environment through the ventilation mesh holes 211. Through above structural arrangement, a center of the thick yarn 2 forms the air channel 22 extending in the axial direction, so that air communication is achieved inside and outside the thick yarn 2 being annularly disposed, so as to enhance breathability of the weighted blanket.

Furthermore, the thick yarn 2 is knitted from a fine yarn 3. In addition to the flexible mesh body 21, the thick yarn 2 further includes other auxiliary portions, or includes only the flexible mesh body 21, that is, the thick yarn 2 is directly knitted from the fine yarn 3, according to the weighted blanket of the present disclosure, the thick yarn is directly knitted from the fine yarn 3, in this way, a mass of weighted blanket is increased and even pressure distribution is easy to achieve, moreover, the weighted blanket further has characteristics of the enhanced breathability and the softness, and simplification of materials and processes is also beneficial for improving a production efficiency thereof. Specifically, the flexible mesh body 21 is knitted from a single strand of the fine yarn 3, two strands of the thin yarn 3, even three strands or four strands of the fine yarn 3.

Furthermore, the fine yarn 3 is layered and wound to form a layered structure of the flexible mesh body 21.

Specifically, during a layering and winding process of the fine yarn 3, connecting knots 214 are formed between adjacent wound segments of the fine yarn 3, and the connecting knots 214 are configured to connect the adjacent wound segments of the fine yarn 3, which is convenient for forming the flexible mesh body 21.

Furthermore, the fine yarn 3 includes sleeving portions 212 extending upward from a current wound segment of the fine yarn 3 and hooking protrusions 213 extending upward from a next wound segment of the fine yarn 3, each of the sleeving portions 212 is sleeved on a corresponding one of the hooking protrusions 213 to form a corresponding one of the connecting knots 214. Certainly, the connecting knots are formed between the current wound segment of the fine yarn 3 and the next wound segment of the fine yarn 3 for facilitating stable connection between the adjacent wound segments of the fine yarn 3.

Figure 3:
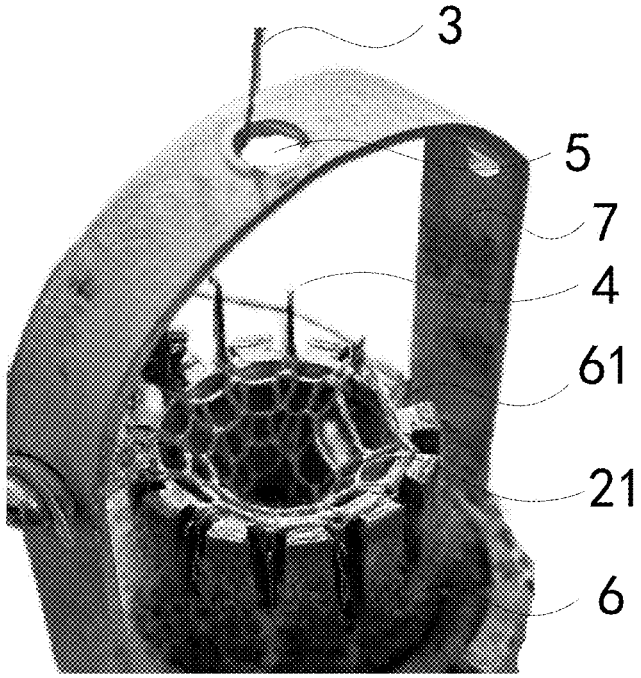
FIG. 3 is a partial structural schematic diagram of a circular knitting machine according to the present disclosure.
Figure 4:
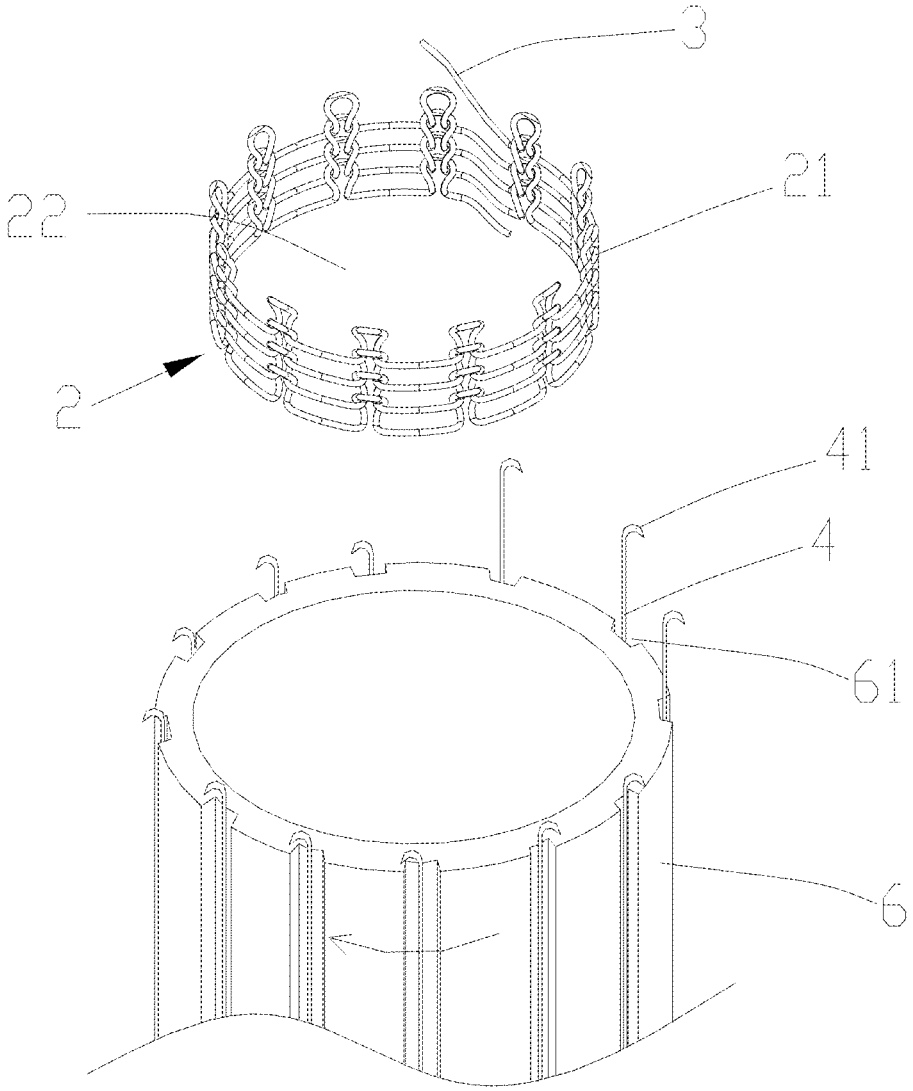
FIG. 4 is a simplified partial schematic diagram of the circular knitting machine according to the present disclosure, wherein an outer housing is removed.

In one embodiment, please refer to FIGS. 3-4, the fine yarn 3 is knitted on a circular knitting machine to form the flexible mesh body 21. The circular knitting machine is suitable for sewing round fabrics, such as clothing, and is typically configured to sew heavier special fabrics, such as thick canvas or leather. The circular knitting machine not only sews flat surfaces but also handles various complex curves and arched lines, including diamond shapes, spherical patterns, and circular designs. A knitting principle of the circular knitting machine involves knitting through a cylindrical needle bed. Needles are fixed on the cylindrical needle bed, and a yarn is fed through a yarn guide, as the needles rotate, the yarn forms loops during in a continuous process.

In the embodiments, please refer to FIGS. 3-4, the circular knitting machine includes a needle cylinder 6 being cylindrical and an outer housing 7 disposed at a periphery of the needle cylinder 6, a yarn inlet 5 is defined on a top of the outer housing 7 and a yarn inlet arm (not shown in the drawings) is disposed at one side of the outer housing 7, an outer peripheral surface of the needle cylinder 6 defines needle grooves 61, the needle grooves 61 are arranged at an equal angle on the outer peripheral surface of the needle cylinder 6, the needle grooves 61 are configured to accommodate the latch needles 4, each of the latch needles 4 is fixed at a bottom of a corresponding one of the needle grooves 61, and a knitting portion 41 is disposed at one end of each of the latch needles 4 facing away from the bottom of the corresponding one of the needle grooves 61. The knitting portion 41 has an open state and a closed state, for example, the knitting portion 41 including a locking device, when the knitting portion 41 is in the open state, the locking device is opened so that the fine yarn 3 originally accommodated in the knitting portion 41 is disengaged from the knitting portion 41, and when the knitting portion 41 is in the closed state, the locking device is closed so that the fine yarn 3 cannot be disengaged from the knitting portion 41. It should be noted that a specific structure of each of the latch needles 4 is a conventional structure, which is not shown in detail in FIG. 4. The latch needles 4 are capable of axially moving, the outer housing 7 is capable of rotating with respect to the needle cylinder 6, for example, a driving belt is disposed on an outer peripheral surface of the outer housing 7, a driving device drives the driving belt to drive the outer housing 7 to rotate, and the needle cylinder 6 is fixed. In operation, the fine yarn 3 enters the circular knitting machine through the yarn inlet 5 defined on the top of the outer housing 7, enters the needle cylinder 6 through the yarn inlet arm, and is knitted by the latch needles 4 respectively accommodated in the needle grooves 61 to form the flexible mesh body 21. Specifically, the outer housing 7 is driven to rotate to drive the fine yarn 3 to rotate around the needle cylinder 6, so that the fine yarn 3 is in sequential contact with the latch needles 4, and the latch needles 4 moves up and down in sequence, specifically, when each of the latch needles 4 moves upward, that is, a corresponding knitting portion 41 moves away from the bottom of the corresponding one of the needle grooves 61 the corresponding knitting portion 41 is in the open state, so that a corresponding segment of the fine yarn 3 originally wound around the corresponding knitting portion 41 is disengaged from the corresponding knitting portion 41, enters a handle portion of a corresponding one of the latch needles 4, and a new yarn hooking operation is completed at the corresponding knitting portion 41; when each of the latch needles 4 moves downward, that is, each of the latch needles move toward the bottom of the corresponding one of the needle grooves 61, the corresponding knitting portion 41 is in the closed state, so that a newly hooked segment of the fine yarn 3 is depressed below the corresponding segment of the fine yarn 3 entering the handle portion of the corresponding one of the latch needles 4, at this time, the corresponding segment of the fine yarn 3 originally located at the handle portion winds the newly hooked segment of the fine yarn 3 and disengages from the handle portion to form the flexible mesh body 21 to complete a knitting operation. The flexible mesh body 21 of the present disclosure is knitted from the fine yarn 3 through the circular knitting machine, which not only ensures a weight of the thick yarn 2 but also enhances breathability and comfort of the weighted blanket due to the formation of an even and breathable mesh structure, furthermore, a production process of the weighted blanket of the present disclosure has a high degree of automation and a simple process, does not need to manufacture an interlayer and adds other weighting materials, thereby greatly improving the production efficiency.

In the embodiments of the present disclosure, the number of strands of the thick yarn 2 is controlled by controlling the number of strands of the fine yarn 3 and the number of the latch needles 4 of the circular knitting machine. Specifically, the fine yarn 3 is knitted by 6 to twelve latch needles 4 to form the flexible mesh body 21, and the number of the connecting knots between the adjacent wound segments of the fine yarn 3 is selected according to the number of the latch needles 4. The number of the strands of the fine yarn 3 may be a single strand or two strands. The more latch needles 4 are, the more the strands are, the denser the flexible mesh body 21 of the thick yarn 2, and the higher the unit grams of the thick yarn 2. Therefore, a relatively accurate mass requirement of users on the weighted blanket is satisfied.

In one embodiment, the flexible mesh body 21 is formed by knitting a single strand of the fine yarn 3. Furthermore, the single strand of the fine yarn 3 is fed into the circular knitting machine after passing through six latch needles 4 to obtain the thick yarn 2, the thick yarn 2 has a weight of six grams per meter. Furthermore, the single strand of the fine yarn 3 is fed into the circular knitting machine after passing through twelve latch needles 4 to obtain the thick yarn 2, the thick yarn 2 has a weight approximate to thirteen grams per meter. In a case where a mass is required to be small, the single strand of the fine yarn 3 and a small number of the latch needles 4 are selected to manufacture the thick yarn 2.

In one embodiment, the flexible mesh body 21 is formed by knitting two strands of the fine yarn 3. Furthermore, the two strands of the fine yarn 3 are fed into the circular knitting machine after passing through six latch needles 4 to obtain the thick yarn 2, the thick yarn 2 has a weight of thirteen grams per meter. Furthermore, the two strands of the fine yarn 3 are fed into the circular knitting machine after passing through twelve latch needles 4 to obtain the thick yarn 2, the thick yarn 2 has a weight approximate to twenty-five grams per meter. In a case where the mass is required to be large, the two strands of the fine yarn 3 and a large number of the latch needles 4 are selected to manufacture the thick yarn 2.

Figure 5:
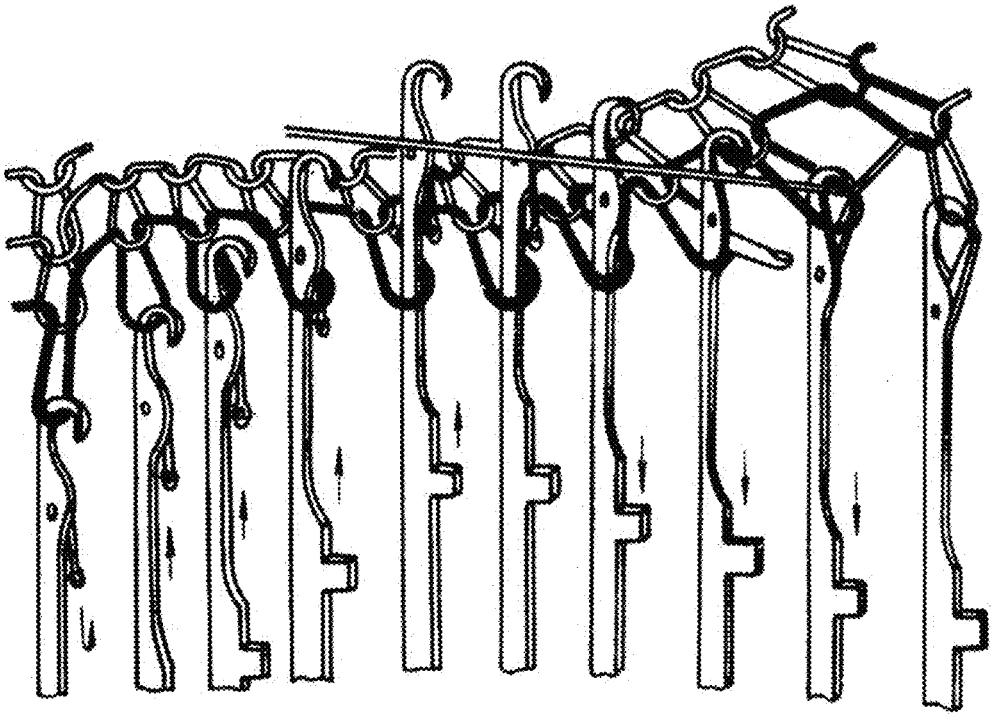
FIG. 5 is a simplified schematic diagram illustrating a knitting process on the flat knitting machine according to the present disclosure.
Figure 6:
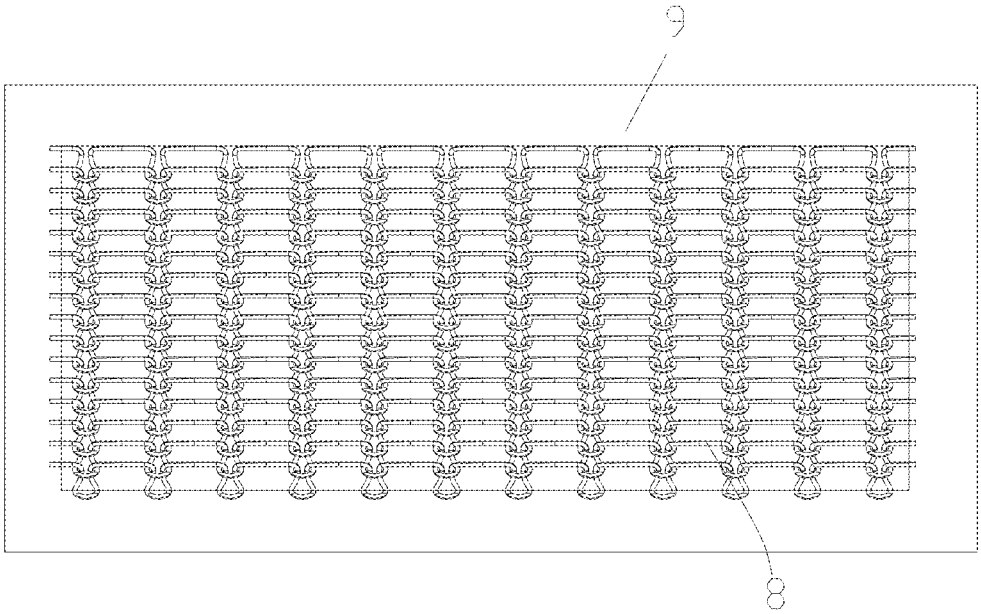
FIG. 6 is a schematic diagram of a main body portion and a surrounding portion according to the present disclosure.

In the embodiments, please refer to FIG. 5, the thick yarn 2 is knitted on a flat knitting machine to form the blanket body 1. The flat knitting machine is a device with rapid stitch formation, suitable for sewing garments, bedding, curtains, bags, etc. Due to the rapid stitch formation, the flat knitting machine enables quicker production and is ideal for production line operations or extended use. A knitting principle of the flat knitting machine involves a carriage equipped with loop-forming components moving back and forth across a needle bed, driving needles to move up and down within needle grooves to complete a knitting process. In addition to the blanket body 1, the weighted blanket further includes other auxiliary portions, or includes only the blanket body 1. The blanket body 1 offers a variety of knitting patterns for selection. When using the flat knitting machine to knit the blanket body 1, the variety of the knitting patterns is preloaded into the flat knitting machine for selection. Alternatively, the variety of the knitting patterns is provided through external devices, such as external storage devices, or is accessed via an internet connection. Furthermore, user-customized knitting patterns are be employed.

In the embodiments, the blanket body 1 includes a main body portion 8 and a surrounding portion 9, and the surrounding portion 9 is knitted around the main body portion 8 to further enhance aesthetic appeal of the weighted blanket. Both the main body portion 8 and the surrounding portion 9 offer a variety of knitting patterns for selection. By incorporating both the main body portion 8 and the surrounding portion 9 and providing the variety of the knitting patterns for each, customization requirements of the users for an appearance of the weighted blanket is better satisfied.

In the description of the present disclosure, it should be understood that terms "longitudinal", "radial", "length", "width", "thickness", "upper", "lower", "front", "rear", "left", "right", "vertical", "horizontal", "top", "bottom", "inner", "outer", etc. are merely intended to facilitate describing the present disclosure and simplify the description, rather than indicating or implying that a device or element referred to must have a specific orientation or be constructed and operated in a specific orientation, and thus cannot be understood as a limitation to the present disclosure. In the description of the present disclosure, unless otherwise specified, "a plurality of" means two or more.

When ordinal numbers, such as "first" and "second", are mentioned in the embodiments of the present disclosure, unless an order is expressed according to a specific context, it should be understood that the ordinal numbers are only used for distinguishing.

Technical features of the embodiments described above can be combined in any manner. For the sake of brevity, not all possible combinations of these technical features have been described in the embodiments described above. However, any combination of these technical features that does not result in a contradiction should be considered within a scope of the present disclosure.

The embodiments described above only express several embodiments of the present disclosure, and the description thereof is relatively specific and detailed, but cannot be understood as a limitation on a protection scope of the present disclosure. It should be noted that, for those who skilled in the art, several modifications and improvements may be made without departing from a concept of the present disclosure, which shall all fall within the protection scope of the present disclosure. Therefore, the protection scope of the present disclosure shall be subject to the appended claims.

What is claimed is:

1. A weighted blanket, comprising:

a blanket body;

wherein the blanket body is knitted from a thick yarn, the thick yarn comprises a flexible mesh body, the flexible mesh body extends along an axial direction of the thick yarn, and the flexible mesh body forms ventilation mesh holes;

wherein the thick yarn further comprises an air channel, wherein the flexible mesh body is annularly disposed to surround the air channel, and wherein the air channel is communicated with an external environment through the ventilation mesh holes; wherein the thick yarn is knitted from a fine yarn; wherein the fine yarn is layered and wound to form a layered structure of the flexible mesh body;

wherein during a layering and winding process of the fine yarn, connecting knots are formed between adjacent wound segments of the fine yarn, and wherein the connecting knots are configured to connect the adjacent wound segments of the fine yarn.

2. The weighted blanket according to claim 1, wherein the fine yarn comprises sleeving portions extending upward from a current wound segment of the fine yarn and hooking protrusions extending upward from a next wound segment of the fine yarn, each of the sleeving portions is sleeved on a corresponding one of the hooking protrusions to form a corresponding one of the connecting knots.

3. The weighted blanket according to claim 2, wherein the fine yarn is knitted on a circular knitting machine to form the flexible mesh body.

4. The weighted blanket according to claim 3, wherein the fine yarn is knitted by 6 to twelve latch needles to form the flexible mesh body.

5. The weighted blanket according to claim 3, wherein the flexible mesh body is formed by knitting a single strand of the fine yarn.

6. The weighted blanket according to claim 5, wherein the single strand of the fine yarn is fed into the circular knitting machine after passing through six latch needles to obtain the thick yarn, the thick yarn has a weight, defined as a mass per unit length, of six grams per meter.

7. The weighted blanket according to claim 5, wherein the single strand of the fine yarn is fed into the circular knitting machine after passing through twelve latch needles to obtain the thick yarn, the thick yarn has a weight, defined as a mass per unit length, approximate to thirteen grams per meter.

8. The weighted blanket according to claim 3, wherein the flexible mesh body is formed by knitting two strands of the fine yarn.

9. The weighted blanket according to claim 8, wherein the two strands of the fine yarn are fed into the circular knitting machine after passing through six latch needles to obtain the thick yarn, the thick yarn has a weight, defined as a mass per unit length, of thirteen grams per meter.

10. The weighted blanket according to claim 8, wherein the two strands of the fine yarn are fed into the circular knitting machine after passing through twelve latch needles to obtain the thick yarn, the thick yarn has a weight, defined as a mass per unit length, approximate to twenty-five grams per meter.

11. The weighted blanket according to claim 1, wherein the thick yarn is knitted on a flat knitting machine to form the blanket body.

12. The weighted blanket according to claim 11, wherein the blanket body has a plurality of knitting patterns.

13. The weighted blanket according to claim 11, wherein the blanket body comprises a main body portion and a surrounding portion, and the surrounding portion is knitted around the main body portion.

14. The weighted blanket according to claim 13, wherein both the main body portion and the surrounding portion have a plurality of knitting patterns.

* * * * *